United States Patent [19]

Kobayashi et al.

[11] Patent Number: 4,516,006

[45] Date of Patent: May 7, 1985

[54] PUFFER TYPE GAS-BLAST CIRCUIT BREAKER

[75] Inventors: Akio Kobayashi; Hitoshi Mizoguchi, both of Yokohama; Hisatoshi Ikeda, Zushi; Hidekiyo Mayama, Yokohama, allof, Japan

[73] Assignee: Tokyo Shibaura Denki Kabushiki Kaisha, Kawasaki, Japan

[21] Appl. No.: 463,121

[22] Filed: Feb. 2, 1983

[30] Foreign Application Priority Data

Mar. 9, 1982 [JP] Japan ..... 57-35868

[51] Int. Cl.[3] ..... H01H 33/88

[52] U.S. Cl. ..... 200/148 A; 200/148 B; 200/144 AP

[58] Field of Search ..... 200/148 A, 148 R, 148 B, 200/144 AP, 145

[56] References Cited

U.S. PATENT DOCUMENTS

| | | | |
|---|---|---|---|
| 2,185,719 | 1/1940 | Baker | 200/145 |
| 2,279,536 | 4/1942 | Thommen | 200/145 |
| 3,214,543 | 10/1965 | Colclaser, Jr. et al. | 200/148 B |
| 3,728,504 | 4/1973 | Beier | 200/144 AP |
| 3,970,811 | 7/1976 | Krebs | 200/148 A |
| 4,220,838 | 9/1980 | Thaler et al. | 200/148 A |
| 4,291,208 | 9/1981 | Cromer et al. | 200/148 A |
| 4,322,591 | 3/1982 | Andersson | 200/148 A |
| 4,324,959 | 4/1982 | Hall et al. | 200/148 A |
| 4,421,962 | 12/1983 | Thuries et al. | 200/148 R |

FOREIGN PATENT DOCUMENTS

| | | | |
|---|---|---|---|
| 2844323 | 6/1979 | Fed. Rep. of Germany | 200/148 A |
| 1514265 | 1/1968 | France | 200/144 AP |
| 2057152 | 5/1971 | France | 200/148 A |

*Primary Examiner*—Robert S. Macon

*Attorney, Agent, or Firm*—Oblon, Fisher, Spivak, McClelland & Maier

[57] ABSTRACT

A puffer type gas-blast circuit breaker provided with a movable electrode and a fixed electrode opposite the movable electrode, which electrodes are separable for implementing a circuit-breaking action, and a fixed current-carrying contact arranged around the periphery of the fixed electrode. The movable electrode is equipped with a surrounding insulating nozzle having a tapered inside surface. Movement of the movable electrode during separation of the electrodes compresses the gas in a puffer chamber and so blows out the resulting arc between the movable and fixed electrodes. The circuit breaker further includes a cylindrical insulator or capacitor that surrounds the arc extinction chamber formed by the electrodes and the insulating nozzle between the movable and fixed electrodes. In the circuit-breaking action, the line of extension of the tapered inside surface of the insulating nozzle downstream, as regards the gas flow, from the throat portion of the insulating nozzle, and extending in the direction of the fixed contact, lies within the innermost portion of the extreme end portion of the fixed current-carrying contact, on the side of the fixed contact nearest the movable electrode.

2 Claims, 3 Drawing Figures

PUFFER TYPE GAS-BLAST CIRCUIT BREAKER

BACKGROUND OF THE INVENTION

1. Field of the Invention

This invention relates to a puffer type gas-blast circuit breaker, wherein an arc extinguishing gas is compressed by a piston and cylinder device during a trip action.

2. Description of the Prior Art

With the recent trend to higher voltages and greater capacity in power transmission systems, the short-circuit currents that must be interrupted by circuit breakers have suddenly increased, and the voltages which are applied to circuit breakers after current interruption have also continuously tended to increase. To improve circuit breaker performance it is therefore absolutely essential to raise the dielectric strength between the electrodes.

As disclosed in U.S. Pat. No. 3,728,504, the puffer type gas-blast circuit breaker of the prior art includes an arc extinguishing chamber which consists of a movable electrode which is fixed only to a grounded tank and a fixed electrode which is supported relative to the movable electrode by a rod type capacitor to distribute uniformly the voltage over the electrodes during the current interruption.

As disclosed in another embodiment of the prior art, a puffer type gas-blast circuit breaker includes an arc extinguishing chamber covered by a cylindrical capacitor for improving the voltage distribution over the electrode during current interruption in order to prevent the compressed arc extinguishing gas flow directly into the grounded tank from the arc extinguishing chamber.

Thus when the high-temperature gas, through which passes the arc which is generated during circuit breaking, is blown out from the gap formed between the extreme end of the fixed side of the conventional grounded tank puffer gas-blast circuit breaker and the extreme end of its insulating nozzle, in the open condition, into the inside of the surrounding insulating tube or cylindrical capacitor, heat penetrates into the inside surface of the insulating tube or cylindrical capacitor, causing deterioration, and in particular carbonization. This lowers the degree of insulation provided by the inside face of the insulating tube or cylindrical capacitor. As a result its performance cannot be improved.

SUMMARY OF THE INVENTION

Accordingly, it is an object of the invention to provide a novel puffer type gas-blast circuit breaker free of the above-noted disadvantages.

Another object of this invention is to provide a novel puffer type gas-blast circuit breaker having a simple structure.

A further object of this invention is to provide a novel puffer type gas-blast circuit breaker which is strongly constructed.

These and other objects are achieved according to the invention by providing a novel puffer type gas-blast circuit breaker provided with a movable electrode and a fixed electrode opposite the movable electrode, which electrodes are separable for implementing a circuit-breaking action, and a fixed current-carrying contact arranged around the periphery of the fixed electrode. The movable electrode is equipped with a surrounding insulating nozzle having a tapered inside surface. Movement of the movable electrode during separation of the electrodes compresses the gas in the puffer chamber and so blows out the arc between the movable and fixed electrodes. The circuit breaker of the invention further includes a cylindrical insulator or capacitor that surrounds the arc extinction chamber formed by the electrodes and the insulating nozzle between the movable and fixed electrodes. In the circuit-breaking action, the line of extension of the tapered inside surface of the insulating nozzle downstream, as regards the gas flow, from the throat portion of the insulating nozzle, and extending in the direction of the fixed contact, lies within the innermost portion of the extreme end portion of the fixed current-carrying contact, on the side of the fixed contact nearest the movable electrode.

BRIEF DESCRIPTION OF THE DRAWINGS

A more complete appreciation of the invention and many of the attendant advantage thereof will be readily obtained as the same becomes better understood by reference to the following detailed description when considered in connection with the accompanying drawings, wherein.

DESCRIPTION OF THE PREFERRED EMBODIMENTS

Figure 1:
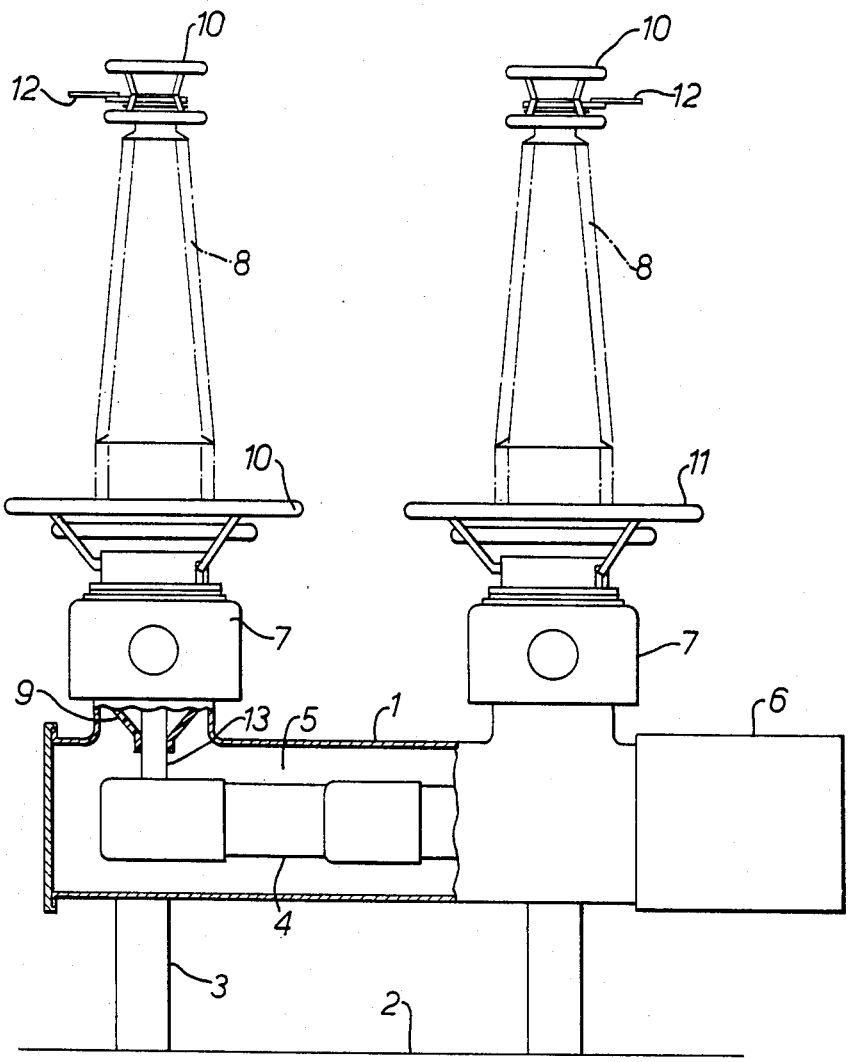
FIG. 1 is a fragmentary side view, partly in cross-section, illustrating a puffer type gas-blast circuit breaker according to this invention.

Referring now to the drawings, wherein like reference numerals designate identical or corresponding parts throughout the several views, and more particularly to FIG. 1 thereof, a grounded tank 1 is mounted upon a foundation 2 via a supporting frame 3. The grounded tank 1 contains an insulating gas 5, for example sulfur hexfluoride ($SF_6$), sealed therein at a pressure of 3.5 kg/cm$^2$. In the atmosphere of the insulating gas 5, an interrupting section 4 which is not shown in detail is insulated and supported by an insulating support (not shown). A driving device 6 which actuates the movable parts of the interrupting section 4 is provided exterior to the grounded tank 1. Bushings 8 are mounted upon the grounded tank 1 and current transformers 7 are also mounted on the outer periphery of the bushings 8. The bushings 8 are filled with the same insulating gas as is sealed in the grounded tank 1. Shielding rings 10 and 11 are respectively mounted upon upper and lower outer periphery of the bushings 8 for providing a smooth electric field. On the upper part of the bushings 8, a terminal strip 12 is mounted to connect a conductor 13 of the bushing 8 and a busbar (not shown). Terminal strip 12 and the interrupting section 4 are electrically connected with each other via the conductor 13 which penetrates through the bushing 8.

Figure 2:
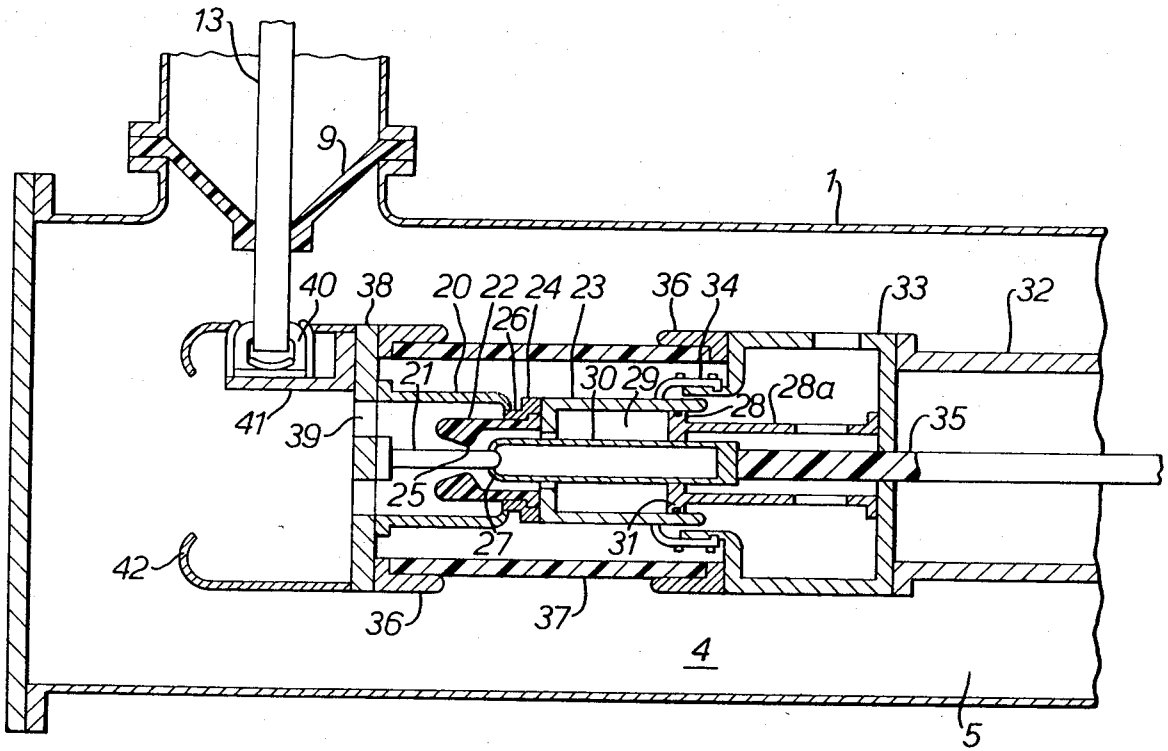
FIG. 2 is a fragmentary side view, partly in cross-section, illustrating the circuit breaker shown in FIG. 1 in a closed position.

Referring to FIG. 2 which shows details of a cross-sectional view of the interrupting section 4 when in a closed position, the numeral 20 indicates a fixed current-carrying contact during main current conduction and the numeral 21 indicates a fixed arc contact during occurrence of arc current. The numeral 22 indicates an insulating nozzle which is mounted upon a puffer cylinder 23 by means of a nozzle supporting material 24. The insulating nozzle 22 includes a throat part 25 which is so narrow that the fixed arc contact 21 can be inserted. Nozzle 22 is outwardly tapered from the throat part 25 to the end of the nozzle 22.

The outer periphery of the nozzle supporting material 24 constitutes a movable main contact 26. The numeral 27 indicates a movable arc contact which is located in the center of the nozzle 22. Contact 27 is cylindrical so that the fixed arc contact 21 can be inserted therein. The numeral 28 indicates a puffer piston on which the puffer cylinder 23 slides. The puffer piston 28 and the puffer cylinder 23 constitute a puffer chamber 29. In the center of the puffer cylinder 23, a supporting tube 30 penetrates and is connected with the movable arc contact 27 at its end. A packing 31 is set at the outer periphery of the puffer piston 28 and makes the gap between the puffer piston 28 and the puffer cylinder 23 airtight and the puffer cylinder 23 slidable along the puffer piston 28. The puffer piston 28 is fixed on a fixed member 33 which is supported by a fixed section 32 via a supporting material 28*a*. Resilient fingers 34 are located on the fixed member 33 and connect the puffer cylinder 23 and the fixed member 33 electrically. An insulating rod 35 is connected with the supporting tube 30. At the other end of the fixed member 33, an insulating cylinder or a cylindrical capacitor 37 is mounted via a ring 36. The other end of the cylindrical capacitor 37 supports a ring 38 which also supports the fixed current-carrying contact 20 and the fixed arc contact 21. There are several holes 39 in the inner side, adjacent where the fixed main contact 20 is located of the ring 38. Mounted on ring 38 is a supporting plate 41 which supports resilient fingers 40. For a smooth electric field, a shield 42 is mounted on the ring 38 to shield the resilient fingers 40. The cylindrical capacitor 37 consists of electrode foil and mold material which is filled in the electrode foil.

In the circuit having the above-mentioned structure, current runs through the conductor 13, the resilient fingers 40, the ring 38, the fixed current-carrying contact 20, the movable current-carrying contact 26, the puffer cylinder 23, the resilient fingers 34, the fixed member 33, the fixed section 32 and the conductor in the right bushing shown in FIG. 1.

Figure 3:
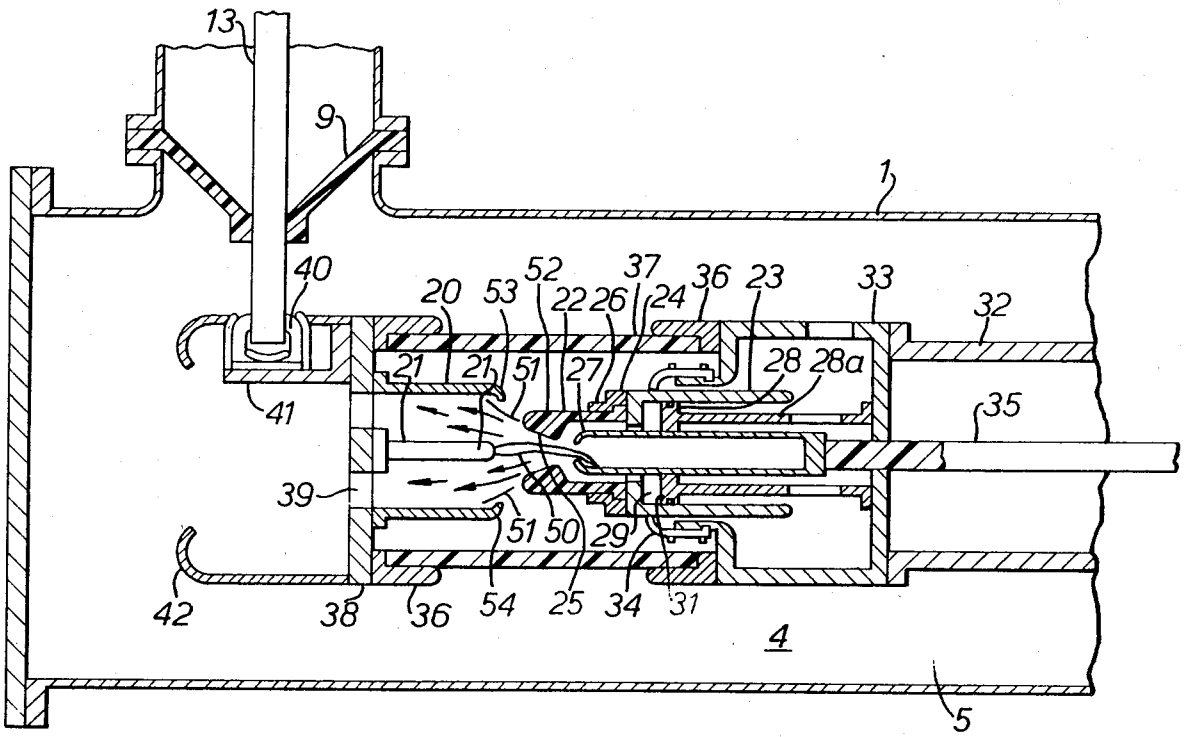
FIG. 3 is a fragmentary side view, partly in cross-section, illustrating the circuit breaker shown in FIG. 1 in an open position.

When a breaking operation is to be performed, a force is applied by the operating device 6 of the circuit breaker rightwardly on the insulating rod 35 shown in FIG. 2. As shown in FIG. 3, the puffer cylinder 23, the insulating nozzle 22, the movable current-carrying contact 26 and the movable arc contact 27 thus move to the right. As a result, at first, the fixed current-carrying contact 21 and the movable current-carrying contact 26 are separated. At this stage, a current runs through the fixed arc contact 21, movable arc contact 27, the puffer cylinder 23 and the resilient fingers 34. When a breaking operation is further to be performed, the fixed arc contact 21 and movable arc contact are separated and an arc 50 is created therebetween. An insulating gas in the puffer chamber 29 which consists of the puffer piston 28 and the puffer cylinder 23 is thus highly compressed. This compressed insulating gas is blown to the arc 50 through the space between the insulating nozzle 22 and fixed arc contact 21 and also into the hollowed center of the movable arc contact 27 from the puffer cylinder 23 and extinguishes the arc 50.

The construction is such that, in the circuit-breaking condition, the line of extension 51 of the tapered inside surface of the insulating nozzle 22, which is downstream (in respect of the gas flow) from the throat section 25 of the nozzle 22, lies inside the radially innermost portion 53 of the extreme end portion 54 of the fixed current-carrying contact 20, which extreme end portion 54 is on the side of the fixed current-carrying contact 20 which is nearest the movable contact 27.

Before explaining the effect which is achieved by this construction, the results of recent investigations concerning the gas flow in the region downstream of the nozzle will be described. As a result of observations carried out, using the optical Schlieren method, by means of a high-speed camera, on the gas flow in the region downstream of the nozzle, it has been found that, even in the period in which the arc is generated, the gas flow occurs within the nozzle line of extension 51 in the direction of the fixed contact 21 from the inside surface 52 of the nozzle downstream of the nozzle throat portion 25. That is, it was found that if the line of extension 51 intersects that portion 54 of the fixed contact 20 which is its extreme end closest to the movable contact 27, when the so-called boundary layer, which is the outermost portion of the gas flow, is at its widest, the intersection of this boundary layer with the extreme end portion 54 closest to the movable contact causes the gas flow to be arrested in this region. Also part of the gas flow is outwards from the extreme end portion 54 on the side facing the movable contact 27. It was also found that, when the line of extension 51 was outside the extreme end portion 54 facing the movable contact 27, an even larger gas flow was directed outwards from the extreme end portion 54. Since this is in fact the conventional configuration, it was realized that this leads to the hot gas being blown into the insulating tube or cylindrical capacitor 37 which surrounds the contacts.

In contrast, with the construction of this invention, even if, in the circuit-breaking condition, there were a gap between the extreme end portion 54, facing the movable contact, of the current-carrying fixed contact 20, and the extreme downstream end portion of the insulating nozzle 22, since the gas flow occurs inside of the current-carrying fixed contact 20, there is no chance of the hot gas being blown onto the inside of the insulating tube or cylindrical capacitor 37 and so there is no adverse effect on the insulation provided by the inside of this insulating tube or cylindrical capacitor 37. Thus, according to the invention, a puffer type gas-blast circuit breaker of superior performance can be obtained.

According to the present invention, the hot gas being blown onto the inside of current-carrying fixed contact 20 is blown out through the holes 39 of the disk 38 into the tank 1 which is filled with fresh insulating gas 5. Under these conditions, the hot gas blown out into the tank has no bad insulating influence due to mixture with fresh insulating gas.

In the case of circuit breaker having a multibreaking point, cylindrical capacitor 37 which is inserted between the fixed arc electrode and the movable arc electrode supresses the resticking voltage during the breaking operation.

Furthermore, it is not necessary to support the current-carrying fixed electrode and fixed arc electrode by the insulating supporting material by virtue of the construction of supporting the current-carrying fixed contact 20 and fixed arc contact 21 by cylindrical capacitor 37. With the construction of this invention, it is possible easily to construct the fixed electrode and the movable electrode and the like and adjust the gap between the fixed electrode and the movable electrode outside of the tank. After the construction of the movable electrode and the fixed electrode, the constructed electrode is inserted into the tank and the fixed electrode is connected with a conductor in the bushing.

The conductor in the bushing is supported by the insulating spacer 9 as shown in the FIG. 1, but it is possible to delete the insulating spacer 9 with the construction that the conductor is supported by the resilient finger 40 at the bottom of the conductor and the connection with the bushing at the top of the conductor.

Thus, according to this invention, it is easy to construct the puffer-type circuit breaker.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A puffer type circuit breaker mounted in a tank containing an insulating gas, comprising:

a movable electrode and a fixed electrode disposed opposite each other, said electrodes being separable for implementing a circuit-breaking action;

a fixed current-carrying contact having an inside surface arranged around a periphery of said fixed electrode and having an extreme end portion defining an innermost portion on a side of said fixed current-carrying contact nearest said movable electrode;

said movable electrode having an end facing said fixed electrode and comprising an insulating nozzle surrounding said end;

a puffer chamber comprising a puffer piston and a puffer cylinder with which said movable electrode is connected for housing insulating gas;

wherein an arc extinction chamber is formed by said electrodes and insulating nozzle in the space between the electrodes;

wherein movement of the movable electrode during separation thereof from the fixed electrode compresses the insulating gas in the puffer chamber such that said gas is released towards said extinction chamber and blows out an arc formed between the movable and fixed electrodes in the arc extinction chamber;

a cylindrical insulator having an inside surface surrounding said arc extinction chamber and supporting a ring at an end of said cylindrical insulator, said ring supporting said fixed electrode and including at least one hole through which insulating gas can pass;

said insulating nozzle having a tapered inside surface tapered to a throat portion in a direction from said stationary electrode to said movable electrode;

wherein in a circuit-breaking action, the line of extension of the inside surface of the insulating nozzle downstream, as regards the gas flow, from the throat portion of the said insulating nozzle, and extending in the direction of the fixed contact, lies within the innermost portion of the extreme end portion, on the side of the fixed contact nearest the movable electrode; and wherein in a circuit breaking action, heated insulating gas is blow only in the inside surface of said fixed contact and through said hole in said ring to mix with and be cooled by insulating gas in said tank such that heated insulating gas is prevented thereby from being blown on the inside surface of the insulator.

2. A puffer type circuit breaker according to claim 1, wherein said cylindrical insulator comprises a capacitor.

* * * * *